US008869437B2

(12) United States Patent
Robl et al.

(10) Patent No.: US 8,869,437 B2
(45) Date of Patent: Oct. 28, 2014

(54) QUICK COUPLER

(75) Inventors: Troy C. Robl, Manhattan, KS (US); Trent R. Stefek, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 231 days.

(21) Appl. No.: 13/483,545

(22) Filed: May 30, 2012

(65) Prior Publication Data

US 2013/0322954 A1 Dec. 5, 2013

(51) Int. Cl.
*E02F 3/36* (2006.01)

(52) U.S. Cl.
USPC ..... 37/468

(58) Field of Classification Search
USPC ..... 37/443, 466, 468, 231, 403–407; 172/272–275; 403/14, 43, 45, 339, 403/340, 364; 414/694, 722, 723, 727
See application file for complete search history.

(56) References Cited

U.S. PATENT DOCUMENTS

| | | | |
|---|---|---|---|
| 3,556,323 | A | 1/1971 | Heimmermann |
| 4,214,840 | A | 7/1980 | Beales |
| 4,295,287 | A | 10/1981 | Natzke et al. |
| 4,373,852 | A | 2/1983 | Mauer |
| 4,417,844 | A | 11/1983 | de Pingon |
| 4,480,955 | A | 11/1984 | Andrews et al. |
| 4,625,988 | A | 12/1986 | Witchey et al. |
| 4,632,595 | A | 12/1986 | Schaeff |
| 4,779,364 | A | 10/1988 | Holmdal |
| 4,790,084 | A | 12/1988 | Anderson et al. |
| 4,845,867 | A | 7/1989 | Albrecht |
| 4,846,624 | A | 7/1989 | Hohn |
| 4,881,867 | A | 11/1989 | Essex et al. |
| 4,906,161 | A | 3/1990 | Weyer |
| 4,955,779 | A | 9/1990 | Knackstedt |
| 4,958,981 | A | 9/1990 | Uchihashi |
| 5,010,962 | A | 4/1991 | Bloom, Jr. |
| 5,024,010 | A | 6/1991 | Hulden |
| 5,082,389 | A | 1/1992 | Balemi |
| 5,107,610 | A | 4/1992 | Fusco |
| 5,108,252 | A | 4/1992 | Gilmore, Jr. et al. |
| 5,110,254 | A | 5/1992 | Aubrey |
| 5,125,788 | A | 6/1992 | Stenger |
| 5,141,385 | A | 8/1992 | Tibbatts et al. |

(Continued)

FOREIGN PATENT DOCUMENTS

| | | |
|---|---|---|
| EP | 1318242 | 6/2003 |
| JP | 09209391 | 8/1997 |

(Continued)

OTHER PUBLICATIONS

"Earth-moving—Quick Couplers—Safety" Draft International Standard ISO/DIS 13031 © International Organization for Standardization (2011).

(Continued)

*Primary Examiner* — Robert Pezzuto
(74) *Attorney, Agent, or Firm* — Miller, Matthias & Hull

(57) ABSTRACT

A quick coupler for connecting an implement to an arm of a machine. The quick coupler includes a frame having a first plate and a second plate. A first and a second pair of recesses provided on the first and the second plates at a first end and a second end of the frame, respectively. A cover plate disposed between the first and the second plates and one or more lubrication lines having fittings attached to terminal ends of the lubrication lines. An external lubrication bank provided on at least one of the first or the second plate to support the fittings.

15 Claims, 3 Drawing Sheets

(56) References Cited

U.S. PATENT DOCUMENTS 5,145,313 A 9/1992 Weyer
5,147,173 A 9/1992 Fauber et al.
5,179,794 A 1/1993 Ballinger
5,195,865 A 3/1993 Koehl
5,222,695 A 6/1993 Lake
5,237,762 A 8/1993 Sandberg
5,242,258 A 9/1993 Weyer
5,256,026 A 10/1993 Kishi
5,324,162 A 6/1994 Kishi
5,332,353 A 7/1994 Arnold
5,333,400 A 8/1994 Sonerud
5,350,250 A 9/1994 Nagler
5,360,313 A 11/1994 Gilmore, Jr. et al.
5,382,110 A 1/1995 Perotto et al.
5,394,630 A 3/1995 Moinat
5,400,531 A 3/1995 Brown
5,415,235 A 5/1995 Gebauer
5,423,625 A 6/1995 Gebauer et al.
5,431,528 A 7/1995 Jenkins et al.
5,456,030 A 10/1995 Barone et al.
5,465,513 A 11/1995 Sonerud
5,467,542 A 11/1995 Hulden
5,484,250 A 1/1996 Gilmore, Jr. et al.
5,487,230 A 1/1996 Weyer
5,494,396 A 2/1996 Geier et al.
5,575,093 A 11/1996 Pratt et al.
5,581,917 A 12/1996 Barden
5,584,644 A 12/1996 Droegemueller
5,597,283 A 1/1997 Jones
5,611,158 A 3/1997 Pratt et al.
5,618,157 A 4/1997 Pratt et al.
5,621,987 A 4/1997 Pratt et al.
5,634,735 A 6/1997 Horton et al.
5,642,785 A 7/1997 Dam-Rasmussen
5,685,689 A 11/1997 Schneider et al.
5,692,325 A 12/1997 Kuzutani
5,692,850 A 12/1997 Kimble et al.
5,692,852 A 12/1997 Collins
5,727,342 A 3/1998 Horton
5,779,429 A 7/1998 Poole
5,791,863 A 8/1998 Droegemueller
5,802,753 A 9/1998 Raunisto
5,813,822 A 9/1998 Pisco
5,820,332 A 10/1998 Phillips et al.
5,865,594 A 2/1999 Kim
5,890,871 A 4/1999 Woeman
5,915,837 A 6/1999 Brown et al.
5,951,192 A 9/1999 Collins
5,966,850 A 10/1999 Horton
5,974,706 A 11/1999 Kaczmarski et al.
5,983,535 A 11/1999 Kaczmarski et al.
6,000,154 A 12/1999 Berard et al.
6,042,295 A 3/2000 Barden
6,058,633 A 5/2000 Barden
6,074,120 A 6/2000 Williams
6,088,393 A 7/2000 Knee et al.
6,088,938 A 7/2000 Logan
6,088,939 A 7/2000 Logan
6,108,951 A 8/2000 Renfrow et al.
6,123,501 A 9/2000 Pisco
6,132,130 A 10/2000 McCann
6,132,131 A 10/2000 Nakamura et al.
6,139,212 A 10/2000 Heiple
6,154,989 A 12/2000 Kaczmarski et al.
6,158,950 A 12/2000 Wilt et al.
6,163,988 A 12/2000 Pratt et al.
6,163,989 A 12/2000 Kaczmarski et al.
6,168,369 B1 1/2001 Bright et al.
6,196,595 B1 3/2001 Sonerud
6,202,331 B1 3/2001 Kobayashi
D440,983 S 4/2001 Miller et al.
6,227,792 B1 5/2001 Baker et al.
6,231,296 B1 5/2001 Blomgren
6,233,852 B1 5/2001 Pemberton
6,241,455 B1 6/2001 Schupback et al.
6,254,331 B1 7/2001 Pisco et al.
6,260,357 B1 7/2001 Goodfellow et al.
RE37,320 E 8/2001 Horton
RE37,339 E 8/2001 Horton
6,301,811 B1 10/2001 Gilmore, Jr.
6,302,611 B1 10/2001 De Gier et al.
6,305,106 B1 10/2001 McLellan
6,308,442 B1 10/2001 Naka et al.
6,312,212 B1 11/2001 Burlew, Jr.
6,332,732 B1 12/2001 Mantovani
6,332,747 B1 12/2001 Lee
6,336,785 B1 1/2002 Kunzman
6,350,079 B1 2/2002 Williams
D455,762 S 4/2002 Kaczmarski et al.
6,364,561 B1 4/2002 Doegemueller
6,379,075 B1 4/2002 Shamblin et al.
6,385,872 B1 5/2002 Mieger et al.
6,386,822 B1 5/2002 Burr
6,408,875 B1 6/2002 Nishikawa et al.
6,422,805 B1 7/2002 Miller
6,428,265 B1 8/2002 Gilmore, Jr.
6,431,785 B1 8/2002 Melander
6,438,875 B1 8/2002 Kimble et al.
6,481,124 B1 11/2002 Miller et al.
6,487,800 B1 12/2002 Evans et al.
6,493,967 B2 12/2002 Holmes et al.
6,499,904 B2 12/2002 Nye
6,508,616 B2 1/2003 Hung
6,513,266 B1 2/2003 Ijiri
6,513,268 B2 2/2003 Lee et al.
6,533,528 B2 3/2003 Degen et al.
6,533,529 B2 3/2003 Waggoner
6,539,650 B2 4/2003 Kaczmarski et al.
6,606,805 B2 8/2003 Kimble et al.
6,615,514 B2 9/2003 Ruiz
6,625,909 B1 9/2003 Miller et al.
6,629,811 B1 10/2003 Husson
6,644,885 B2 11/2003 Dam-Rasmussen
6,655,053 B1 12/2003 Cummungs
6,658,770 B2 12/2003 Heiple
6,659,708 B2 12/2003 Heiple
6,659,709 B1 12/2003 Anderson
6,688,801 B2 2/2004 Husson
6,691,438 B2 2/2004 Fatemi
6,709,224 B2 3/2004 Heiple
6,718,663 B1 4/2004 Geraghty
6,725,584 B2 4/2004 Inoue et al.
6,811,371 B2 11/2004 Mantovani
6,812,851 B1 11/2004 Dukach et al.
6,813,851 B2 11/2004 Mieger et al.
6,857,842 B2 2/2005 Heiple
6,877,259 B2 4/2005 Nishimura et al.
6,881,002 B2 4/2005 Fatemi
6,886,279 B2 5/2005 Kimble
6,899,509 B1 5/2005 Mailleux
6,902,346 B2 6/2005 Steig, Jr. et al.
6,922,926 B2 8/2005 Miller et al.
7,047,866 B2 5/2006 Fatemi et al.
7,367,256 B2 5/2008 Fatemi et al.
7,426,796 B2 9/2008 Cunningham et al.
7,430,955 B2 10/2008 Bitter
7,455,494 B2 11/2008 Krieger
7,648,305 B2 1/2010 Beales
7,654,019 B2 2/2010 Yeager et al.
7,797,862 B2 9/2010 Darale et al.
7,828,070 B2 11/2010 Calvert et al.
7,984,575 B2 7/2011 Robl et al.
8,262,310 B2 9/2012 Sikorski et al.
8,281,506 B2 10/2012 Stefek et al.
2001/0026729 A1 10/2001 Trowbridge
2001/0053323 A1 12/2001 Godwin et al.
2002/0066215 A1 6/2002 Kaczmarski et al.
2002/0071754 A1 6/2002 Fatemi
2002/0098032 A1 7/2002 Nye
2002/0136597 A1 9/2002 Nishikawa et al.
2002/0157286 A1 10/2002 Fatemi
2002/0157287 A1 10/2002 Mieger et al.
2002/0170211 A1 11/2002 Lee et al.
2002/0174575 A1 11/2002 Inoue et al.

(56) References Cited

U.S. PATENT DOCUMENTS

| | | | |
|---|---|---|---|
| 2002/0176772 | A1 | 11/2002 | Hung |
| 2002/0178625 | A1 | 12/2002 | Kimble et al. |
| 2003/0005605 | A1 | 1/2003 | Kaczmarski et al. |
| 2003/0095858 | A1 | 5/2003 | Mantovani |
| 2003/0099507 | A1 | 5/2003 | Fatemi |
| 2003/0103806 | A1 | 6/2003 | Short |
| 2003/0131505 | A1 | 7/2003 | Heiple |
| 2003/0133779 | A1 | 7/2003 | Heiple |
| 2003/0154636 | A1 | 8/2003 | Miller et al. |
| 2003/0175072 | A1 | 9/2003 | Steig, Jr. et al. |
| 2003/0204972 | A1 | 11/2003 | Cunningham et al. |
| 2003/0233773 | A1 | 12/2003 | Mieger et al. |
| 2004/0000077 | A1 | 1/2004 | Fatemi |
| 2004/0028515 | A1 | 2/2004 | Martin |
| 2004/0057784 | A1 | 3/2004 | Geraghty |
| 2004/0076504 | A1 | 4/2004 | Geraghty |
| 2004/0165979 | A1 | 8/2004 | Fatemi |
| 2004/0184875 | A1 | 9/2004 | Mieger et al. |
| 2004/0218971 | A1 | 11/2004 | Lim et al. |
| 2004/0247382 | A1 | 12/2004 | Leemans et al. |
| 2005/0169703 | A1 | 8/2005 | Fatemi |
| 2005/0204591 | A1 | 9/2005 | Mieger et al. |
| 2005/0214105 | A1 | 9/2005 | Steig, Jr. et al. |
| 2007/0166143 | A1 | 7/2007 | Hart et al. |
| 2009/0007465 | A1 | 1/2009 | Robl et al. |
| 2009/0282712 | A1 | 11/2009 | Pruszynski |
| 2009/0311086 | A1 | 12/2009 | Steig, Jr. et al. |
| 2010/0061799 | A1 | 3/2010 | Hill |
| 2010/0192425 | A1 | 8/2010 | Miller et al. |
| 2010/0232920 | A1 | 9/2010 | Calvert et al. |
| 2011/0010915 | A1 | 1/2011 | Calvert et al. |
| 2011/0091267 | A1 | 4/2011 | Hill |
| 2011/0209608 | A1 | 9/2011 | Stefek et al. |
| 2013/0000292 | A1 | 1/2013 | Edler et al. |
| 2013/0008153 | A1 | 1/2013 | Stefek et al. |
| 2013/0160268 | A1 | 6/2013 | Parker et al. |
| 2013/0160269 | A1 | 6/2013 | Parker et al. |

FOREIGN PATENT DOCUMENTS

| | | |
|---|---|---|
| JP | 10082066 | 3/1998 |
| JP | 11181819 | 7/1999 |
| JP | 2000001872 | 1/2000 |
| NZ | 233302 | 4/1990 |
| WO | 2011033253 | 3/2011 |

OTHER PUBLICATIONS

U.S. Patent Application of Troy Curtis Robl et al. entitled "Tool Coupler Having Anti-Release Mechanism", filed May 30 2012.

U.S. Patent Application of Troy C. Robl et al. entitled "Locking System for Quick Coupler", filed Apr. 2, 2013.

U.S. Patent Application of Troy Robl et al. entitled "Quick Coupler Hydraulic Control System", filed May 8, 2013.

U.S. Patent Application of Troy Curtis Robl et al. entitled "Tool Coupler Having a Modular Frame Construction ", filed Jan. 25, 2013.

QUICK COUPLER

TECHNICAL FIELD

The present disclosure relates generally to a quick coupler and, more particularly to a cover plate for the quick coupler.

BACKGROUND

A quick coupler is used for connecting earthmoving machinery such as an excavator or a backhoe to an implement such as a bucket, a grapple, or a hammer etc. For example, U.S. Pat. No. 7,984,575 discloses a quick coupler for connecting and disconnecting an implement such as a bucket to and from a machine such as an excavator. In an example, the quick coupler includes a frame having recesses configured to receive pins located on the implement. The quick coupler includes first and second securing latches that are movable between latched and unlatched positions for removably latching the pins of the implement in the recesses.

The quick couplers are often subjected to foreign particles such as debris, mud, water and material that may build up inside the coupler and may cause failure to the mechanism or components associated with the latching members.

SUMMARY

In one aspect, the present disclosure describes a quick coupler for connecting an implement to an arm of a machine. The quick coupler includes a frame having a first plate and a second plate. A first and a second pair of recesses provided on the first and the second plates at a first end and a second end of the frame, respectively. Further, a cover plate disposed between the first and the second plates.

In another aspect, the quick coupler further includes one or more lubrication lines having fittings attached to terminal ends of the lubrication lines. An external lubrication bank provided on at least one of the first or the second plate to support the fittings.

Other features and aspects of this disclosure will be apparent from the following description and the accompanying drawings.

DETAILED DESCRIPTION

Figure 1:
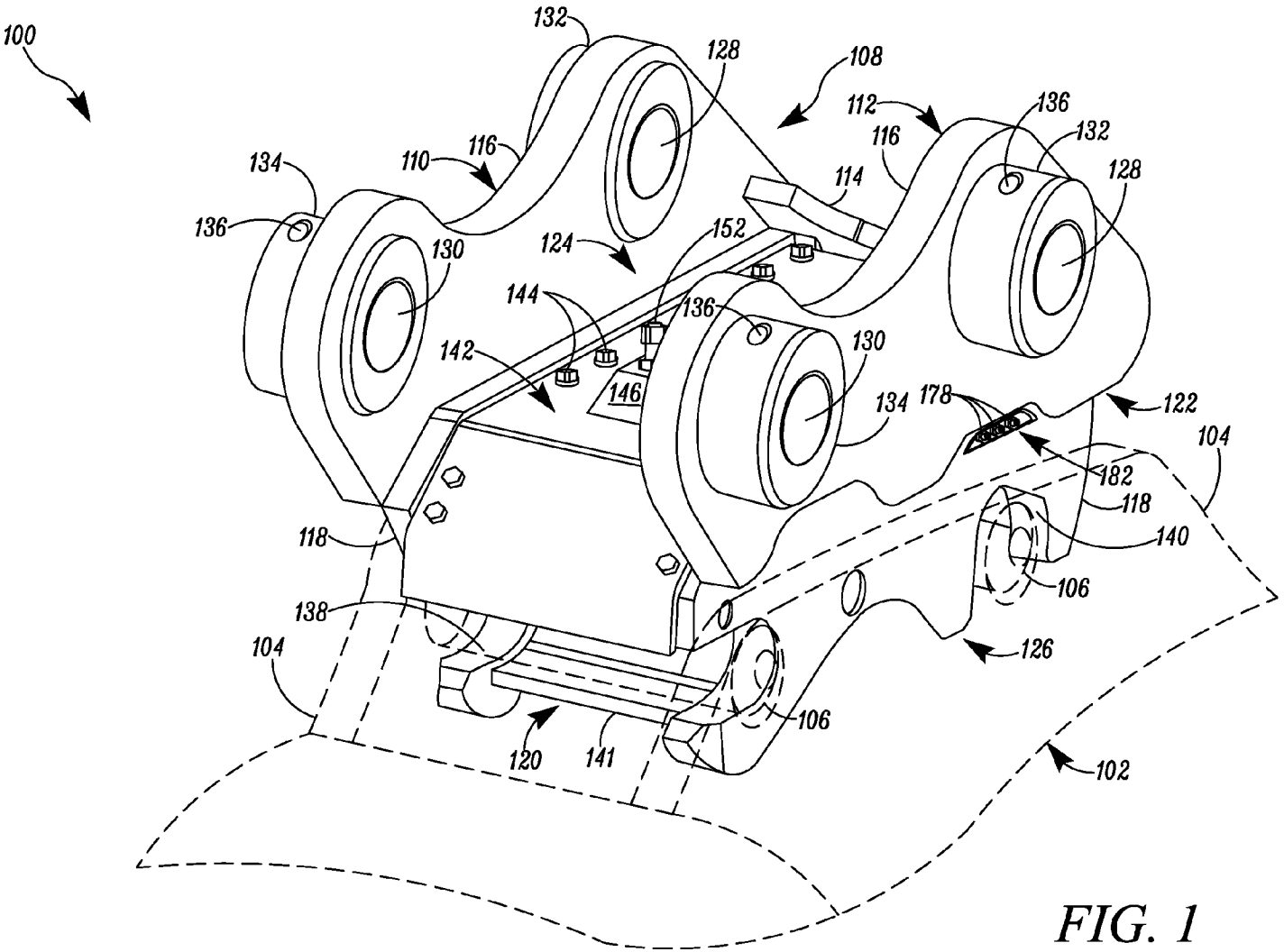
FIG. 1 illustrates a perspective view of a quick coupler with a cover plate in an unlatched position, according to an aspect of the present disclosure.

Referring to FIG. 1, a quick coupler 100 is provided for detachably connecting an implement 102, such as a bucket, to a distal end of an arm or stick (not shown) of a machine, such as an excavator or backhoe loader. As illustrated in FIG. 1, the quick coupler 100 is in an unlatched position and includes a frame 108 having a pair of spaced apart plates, a first plate 110 and a second plate 112 that are interconnected by a cross plate 114. Each of the first and the second plates 110, 112 may include an upper plate 116 and a lower plate 118, respectively. However, it will be appreciated that the first and the second plates 110, 112 may be manufactured as one-piece instead of having the exemplary upper and lower plates 116, 118. In an embodiment, each of the first and the second plates 110, 112 may be casted as one-piece instead of having the upper and lower plates 116, 118. The frame 108 may further include a first end 120, a second end 122, a top portion 124, and a bottom portion 126. As illustrated, the cross plate 114 may be disposed between the first and the second plates 110, 112 at the second end 122.

The top portion 124 of the frame 110 is configured to connect to the arm of the machine. In an exemplary embodiment, the first and the second plates 110, 112 may include a first pair of aligned pin openings 128 and a second pair of aligned pin openings 130 provided on the top portion 124 of the frame 108. Further, collars 132, 134 having securing slots 136 are provided adjacent to each of the first and the second pair of aligned pin openings 128, 130, respectively. The quick coupler 100 is configured to be pivotally connected to the arm of the machine by a pin which is slidably received within the first pair of aligned pin openings 128. Likewise, the quick coupler 100 is configured to be pivotally connected to a power link of the machine by another pin which is slidably received within the second pair of aligned pin openings 130. The power link may be functionally connected to a hydraulic actuator associated with the machine and acts as a lifting mechanism for the implement 102. Moreover, securing pins (not shown) can be inserted through the securing slots 136 provided on the collars 132, 134 to secure the arm and the power link of the machine, in the first and the second aligned pin openings 128, 130.

The bottom portion 126 of the quick coupler 100 is configured to detachably connect to the implement 102. In the exemplary embodiment, each of the first and the second plates 110, 112 may include a first and a second pair of recesses 138, 140 at the bottom portion 126 of the frame 108. The first pair of recesses 138 may be provided in the form of open jaws and disposed proximate to the first end 120 of the frame 108. Additionally, the frame 108 may include a cross-brace 141 that is located proximate to the first pair of recesses 138 and projects or extends from the first plate 110 to the second plate 112, among other things, interconnecting and supporting the first and the second plates 110, 112. The second pair of recesses 140 may be also provided in the form of open jaws disposed proximate to the second end 122 of the frame 108. The first and the second pair of recesses 138, 140 are configured to receive a pair of implement securing pins 106 associated with the implement 102.

According to an embodiment of the present disclosure, a cover plate 142 is detachably attached to the frame 108 and disposed between the first and the second plates 110, 112. The cover plate 142 may be configured to be detachably attached to the lower plates 118 of the first and the second plates 110, 112 by a plurality of connectors 144. The plurality of connectors 144 may include a fastening unit for example, but not limited to, a nut and bolt assembly or any other type of fastening systems. Further, the cover plate 142 may include a protruded area 146 having a pair of bulkhead fittings 152 disposed on a top surface of the protruded area 146. It will be apparent to a person having ordinary skill in the art that the bulkhead fittings 152 may include a nut and rubber washer for sealingly securing a tube about a hole provided on the cover plate 142. The quick coupler 100, the cover plate 142, and the bulkhead fittings 152 may be made of a rigid material such as steel, composite materials, alloys, or any similar materials of sufficient rigidity.

Figure 2:
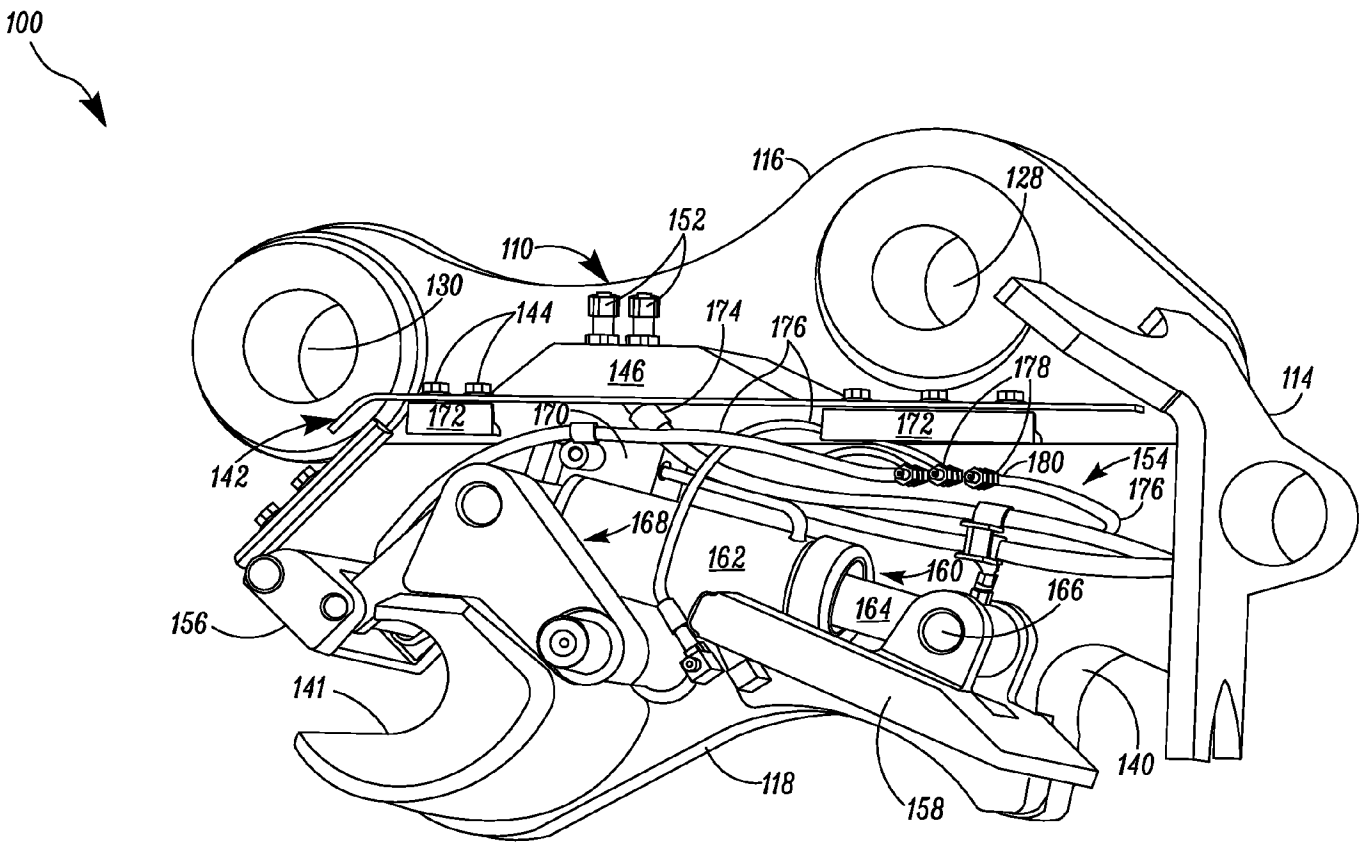
FIG. 2 illustrates a cross-sectional view of the quick coupler in a latched position.

FIG. 2 illustrate a cross-sectional view of the quick coupler 100 in a latched position, with the second plate 112 removed to show a locking system 154 associated with the quick coupler 100. The locking system 154 may include first and second securing latches 156, 158 for securing the implements pins 106 in the first and the second pair of recesses 138, 140, respectively. It will be apparent to a person having ordinary skill in the art that FIG. 2 illustrates the locking system 154 in an unlatched position, and the locking system 154 may include a number of interconnected components for moving the first and the second securing latches 156, 158 from the unlatched position to a latched position. In an embodiment, the locking system 154 may include an actuator 160 operatively connected to the first and the second securing latches 156, 158. The actuator 160 may be a hydraulic piston-cylinder assembly having a cylinder 162 and a piston rod 164 configured to be slidably received in the cylinder 162. However, it will be apparent to a person having ordinary skill in the art that the actuator 160 may be any type of linear actuator, such as, a pneumatically or a motor-driven actuator.

In accordance to an exemplary embodiment of the present disclosure, interconnections and mechanical relationships among the various components of the exemplary locking system 154 will now be described in detail. The first securing latch 156 may be operatively connected to the cylinder 162 via a rocker assembly 168. The cylinder 162 is pivotally connected to the rocker assembly 168 to move the first securing latch 156 between the latched and the unlatched positions. The second securing latch 158 and the piston rod 164 of the actuator 160 are interconnected by a pin 166. More particularly, the pin 166 passes through corresponding bores provided on the second securing latch 158 and the piston rod 164. Further, the actuator 160 may further include a pressure switch 170 for monitoring a cylinder pressure. However, a person having ordinary skill in the art that the operation and the interconnection associated with the locking system 154 are exemplary and are not directed to limit the scope of the present disclosure.

As illustrated in FIG. 2, the cover plate 142 may be supported on mounting members 172 which are protruding from the lower plate 118. The actuator 160 is disposed beneath the cover plate 142 such that the bulkhead fittings 152 may be connected to hydraulic lines 174 operatively connected to the actuator 160. As it will be apparent to a person having ordinary skill in the art that the hydraulic lines 174 may be connected to the pressure switch 170 to control the movement of the actuator 160.

Moreover, the quick coupler 100 may include one or more lubrication lines 176 associated with various components, such as, but not limited to, the rocker assembly 168, the first and the second securing latches 156, 158. The lubrication lines 176 may further include fittings 178, such as, but not limited to, a grease fitting, or a grease nipple, attached to terminal ends 180 of the lubrication lines 176. The fittings 178 allows a lubricant, usually grease, to feed under a pressure, into the various components associated within the quick coupler 100. The fittings 178 may include a threaded connection to couple with the internal lubrication lines 176. It may be apparent to a person having ordinary skill in the art that, the fittings 178 may further include a valve that opens under pressure to allow lubricant to pass through the fittings to the various components within the quick coupler 100.

Referring back to FIG. 1, according to another embodiment of the present disclosure, the first plate 110 may include an external lubrication bank 182. The lubrication lines 176 may be internally routed to the external lubrication bank 182 and connected via the fittings 178. The fittings 178 may be further configured to be connected to an external lubrication supply, such as a grease gun. It may be apparent to a person having ordinary skill in the art that the external lubrication bank 182 may be alternatively provided on either of the first or the second plates 110, 112 without departing from the scope of the present disclosure.

Figure 3:
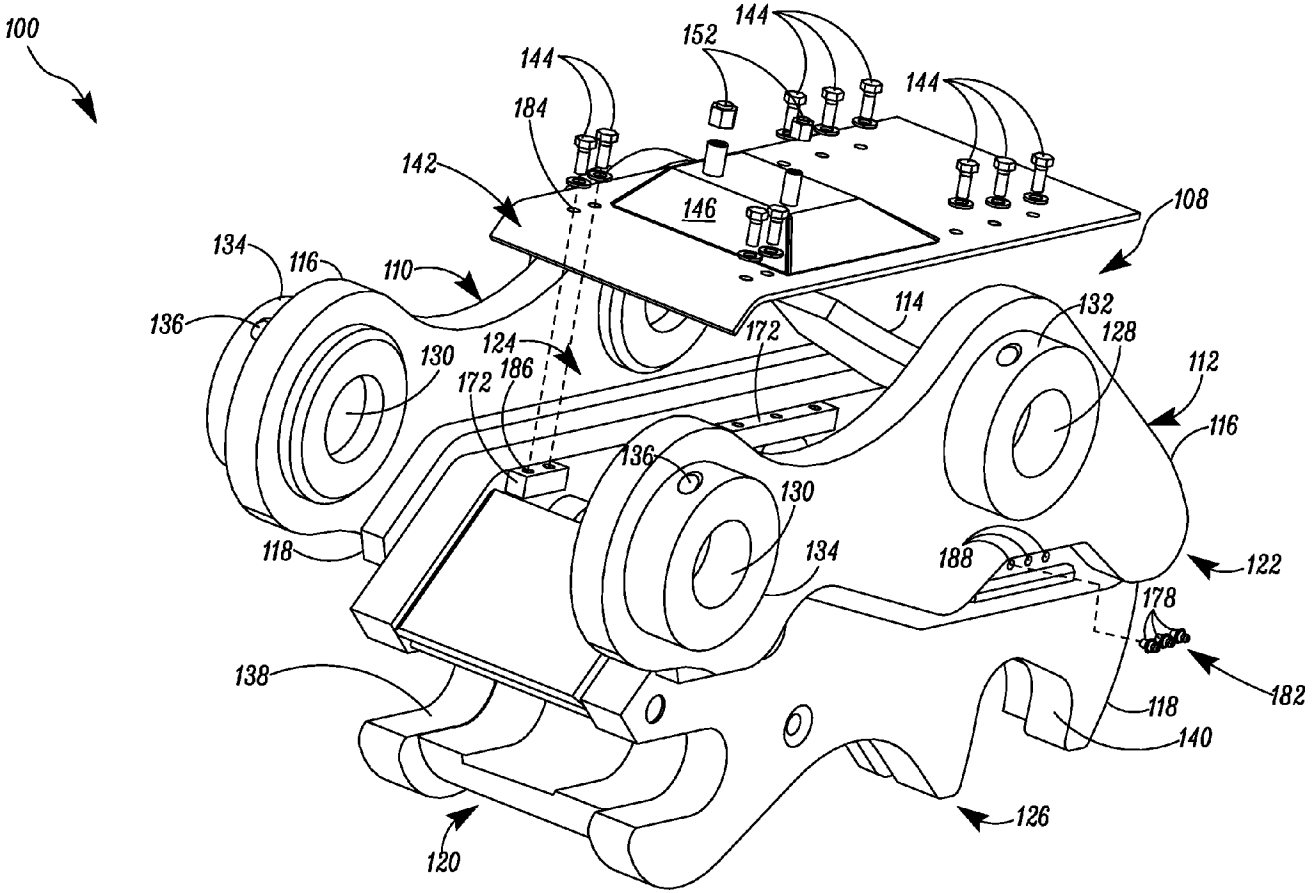
FIG. 3 illustrates an exploded view of the quick coupler, a cover plate, and a lubrication bank, according to the present disclosure.

FIG. 3 illustrates an exploded view of the cover plate 142, the external lubrication bank 182, configured to be detachably connected with the quick coupler 100 in accordance with an embodiment of the present disclosure. The cover plate 142 may have openings 184 aligned with openings 186 formed on the mounting members 172 of which are protruding from the lower plate 118 of the quick coupler 100. The plurality of connectors 144 may be configured to be received into the openings 184, 186 provided on the cover plate 142 and the lower plates 118 of the quick coupler 100 respectively. Further, the first or the second plates 110, 112 may be provided with openings 188 for receiving the fittings 178 of the external lubrication bank 182.

INDUSTRIAL APPLICABILITY

The industrial applicability of the quick coupler 100, described herein will be readily appreciated from the foregoing discussion. The quick coupler 100 of the present disclosure may be widely used on industrial, earthmoving, mining, construction, farming, transportation and material handling machines and vehicles, or the like. It may be contemplated that the quick coupler 100 may be used to detachably/interchangeably connect the implement 102 to an arm of a machine. In various embodiments, the implement 102 may include a bucket, a grapple, a hammer, a multi-processor, a rake, a ripper, a saw, a dozer blade, a pallet fork, a barrel handler, a tire manipulator, a jib boom, a pipe fork, or any other types of work tool attachments. As illustrated in FIG. 1, the implement 102 is provided with a pair of upstanding brackets 104. The brackets 104 are spaced apart by a predetermined distance and having holes aligned with the first and the second pair of recesses 138, 140 of the quick coupler 100. Further, the implement securing pins 106 extends between the brackets 104.

The present disclosure provides an advantageous cover plate 142 as illustrated in FIGS. 1 and 2 to protect the internal components of the quick coupler 100 from debris, mud, water or etc. during the operation of the machine. As described above, the internal components of the quick coupler assembly 100 may include the actuator 160, the first and the second securing latch members 156, 158, the rocker assemblies 168, and the internal routed hydraulic and lubrication lines 174, 176. Further, the bulkhead fittings 152 provided on the cover plate 142 may act as adapters to make swift hydraulic connection based on the requirements, without the need of removing the cover plate 142. Further, the cover plate 142 may include an opaque or a transparent body, the later may be useful for easy inspection of internal components without the removal of cover plate 142. It will be apparent to a person having skill in the art that the cover plate 142 may be likewise used in case of manual quick couplers.

In line with the foregoing discussion, the cover plate 142 may assure effective working of the locking system 154 and also provided an added support to the first and the second plates 110, 112. Thus, contributing to an overall life of the quick coupler 100. The protruded area 146 provided on the cover plate 142 may allow an added space for the bulkhead fittings 152 and for the connection with the hydraulic lines 174. However, it may be contemplated that the bulkhead fittings 152 may be directly provided on a top surface of the cover plate 142.

Moreover, the external lubrication bank 182 provided on the second plate 112 offers a single easily accessible point for supplying the lubricant to all the internal components which require lubrication. Furthermore, the external lubrication bank 182 may allow feeding of the lubricant to any wear points via the internal lubrication lines 176 without having removed the cover plate 142.

It will be apparent to those skilled in the art that various modifications and variations can be made to the disclosed quick coupler without departing from the scope of the disclosure. Other embodiments of the quick coupler will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A quick coupler for connecting an implement to an arm of a machine, the quick coupler comprising:

a frame having a first plate and a second plate;

a first pair of recesses provided on the first and the second plates, the first pair of recesses located at a first end of the frame;

a second pair of recesses provided on the first and the second plates, the second pair of recesses located at a second end of the frame;

a cover plate disposed between the first and the second plates; and a locking assembly including an actuator, a first securing latch, and a second securing latch, and wherein the actuator is disposed beneath the cover plate and operatively coupled to the first securing latch and the second securing latch, wherein the first and second securing latches are configured to secure implements pins in the first and the second pair of recesses, respectively.

2. The quick coupler of claim 1, wherein each of the first and the second plates includes an upper plate and a lower plate, and wherein the cover plate is detachably attached to the lower plates.

3. The quick coupler of claim 1, wherein the cover plate is detachably attached to the lower plates by a plurality of connectors.

4. The quick coupler of claim 1, wherein the cover plate includes a protruded area having one or more bulkhead fittings provided on the protruded area.

5. The quick coupler of claim 4, wherein the one or more bulkhead fittings are configured to be connected with one or more hydraulic lines operatively connected to the actuator.

6. The quick coupler of claim 1 further includes one or more lubrication lines having fittings attached to terminal ends of the lubrication lines.

7. The quick coupler of claim 6, wherein at least one of the first or the second plate includes an external lubrication bank to support the fittings.

8. A quick coupler for connecting an implement to an arm of a machine, the quick coupler comprising:

a frame having a first plate and a second plate; a first pair of recesses provided on the first and the second plates, the first pair of recesses located at a first end of the frame;

a second pair of recesses provided on the first and the second plates, the second pair of recesses located at a second end of the frame;

one or more lubrication lines having fittings attached to terminal ends of the lubrication lines;

an external lubrication bank provided on at least one of the first or the second plate to support the fittings;

a cover plate disposed between the first and the second plates; and a locking assembly including an actuator, a first securing latch, and a second securing latch, and wherein the actuator is disposed beneath the cover plate and operatively coupled to the first securing latch and the second securing latch, wherein the first and second securing latches are configured to secure implement pins in the first and the second pair of recesses, respectively.

9. The quick coupler of claim 8, wherein each of the first and the second plates includes an upper plate and a lower plate, and wherein a cover plate is detachably attached to the lower plates.

10. The quick coupler of claim 9, wherein the cover plate is detachably attached to the lower plates by a plurality of connectors.

11. The quick coupler of claim 9, wherein the cover plate includes a protruded area having one or more bulkhead fittings provided on the protruded area.

12. The quick coupler of claim 11, wherein the one or more bulkhead fittings are configured to be connected with one or more hydraulic lines operatively connected to the actuator.

13. A quick coupler for connecting an implement to an arm of a machine, the quick coupler comprising:

a frame having a first plate and a second plate;

a first pair of recesses provided on the first and the second plates, the first pair of recesses located at a first end of the frame;

a second pair of recesses provided on the first and the second plates, the second pair of recesses located at a second end of the frame;

a cover plate disposed between the first and the second plates; one or more lubrication lines having fittings attached to terminal ends of the lubrication lines;

an external lubrication bank provided on at least one of the first or the second plate to support the fittings; and a locking assembly including an actuator, a first securing latch, and a second securing latch, and wherein the actuator is disposed beneath the cover plate and operatively coupled to the first securing latch and the second securing latch, wherein the first and second securing latches are configured to secure implement pins in the first and the second pair of recesses, respectively.

14. The quick coupler of claim 13, wherein each of the first and the second plates includes an upper plate and a lower plate, and wherein the cover plate is detachably attached to the lower plates.

15. The quick coupler of claim 14, wherein the cover plate is detachably attached to the lower plates by a plurality of connectors.

* * * * *